US008637789B2

(12) United States Patent
Lochtman et al.

(10) Patent No.: US 8,637,789 B2
(45) Date of Patent: Jan. 28, 2014

(54) METHOD FOR PRODUCING METALLISED TEXTILE SURFACES USING ELECTRICITY-GENERATING OR ELECTRICITY-CONSUMING ELEMENTS

(75) Inventors: Rene Lochtman, Mannheim (DE); Norbert Wagner, Mutterstadt (DE); Jürgen Kaczun, Wachenheim (DE); Jürgen Pfister, Speyer (DE); Antonino Raffaele Addamo, Ludwigshafen (DE); Ralf Nörenberg, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 1167 days.

(21) Appl. No.: 12/527,865

(22) PCT Filed: Feb. 19, 2008

(86) PCT No.: PCT/EP2008/051979

§ 371 (c)(1),
(2), (4) Date: Aug. 19, 2009

(87) PCT Pub. No.: WO2008/101917

PCT Pub. Date: Aug. 28, 2008

(65) Prior Publication Data

US 2011/0062134 A1 Mar. 17, 2011

(30) Foreign Application Priority Data

Feb. 20, 2007 (EP) ..... 07102689

(51) Int. Cl.
*D06M 11/74* (2006.01)
*H05B 3/34* (2006.01)

(52) U.S. Cl.
USPC ..... 219/201; 362/103; 438/117

(58) Field of Classification Search
USPC ..... 219/201, 209, 211
See application file for complete search history.

(56) References Cited

U.S. PATENT DOCUMENTS

| | | | | |
|---|---|---|---|---|
| 4,218,218 | A | 8/1980 | Daubach et al. | |
| 4,480,061 | A | 10/1984 | Coughlin et al. | |
| 4,670,351 | A | 6/1987 | Keane et al. | |
| 4,863,995 | A | 9/1989 | Murakami et al. | |
| 5,009,841 | A * | 4/1991 | Bloemacher et al. | 419/23 |
| 5,455,749 | A * | 10/1995 | Ferber | 362/103 |
| 5,839,190 | A | 11/1998 | Sullivan | |
| 6,093,910 | A | 7/2000 | McClintock et al. | |
| 6,194,692 | B1 | 2/2001 | Oberle | |
| 6,311,350 | B1 | 11/2001 | Kaiserman et al. | |
| 6,815,642 | B2 | 11/2004 | Haag et al. | |
| 7,053,344 | B1 | 5/2006 | Surjan et al. | |
| 7,137,697 | B2 | 11/2006 | Lehmann | |
| 2004/0072924 | A1 | 4/2004 | Sigworth et al. | |
| 2005/0034995 | A1 | 2/2005 | Gundlach et al. | |
| 2005/0067007 | A1 | 3/2005 | Toft | |
| 2005/0123744 | A1 | 6/2005 | Mohanty et al. | |
| 2005/0187315 | A1 | 8/2005 | Dean | |
| 2005/0191511 | A1 | 9/2005 | Aoki et al. | |
| 2005/0242081 | A1 | 11/2005 | Howick | |
| 2006/0005876 | A1 | 1/2006 | Gaudiana et al. | |
| 2008/0206553 | A1 | 8/2008 | Schneider et al. | |
| 2009/0011674 | A1 | 1/2009 | Addamo et al. | |

FOREIGN PATENT DOCUMENTS

| | | | |
|---|---|---|---|
| CA | 2489565 | | 12/2003 |
| CA | 2489565 | | 12/2004 |
| CA | 2654797 | A1 | 12/2007 |
| CN | 1124997 | A | 6/1996 |
| DE | 3433437 | A1 | 3/1986 |
| DE | 10051850 | A1 | 10/2001 |
| DE | 10145749 | A1 | 4/2003 |
| DE | 102005043242 | | 3/2007 |
| EP | 0322997 | A2 | 7/1989 |
| EP | 0813550 | | 11/1999 |
| EP | 1911807 | A | 4/2008 |
| GB | 2186436 | A | 8/1987 |
| JP | 58142842 | A | 8/1983 |
| JP | 06-224529 | A | 8/1994 |
| JP | 09-83133 | A | 3/1997 |
| WO | WO 94/28348 | | 12/1994 |
| WO | WO-9829579 | A1 | 7/1998 |
| WO | WO-02-064670 | A | 8/2002 |
| WO | WO-2004-092279 | A | 10/2004 |
| WO | WO-2005020246 | A1 | 3/2005 |
| WO | WO-2007074090 | A1 | 7/2007 |
| WO | WO-2007-095670 | A | 8/2007 |
| WO | WO-2007144322 | A1 | 12/2007 |
| WO | WO-2008-015201 | | 2/2008 |
| WO | WO-2008-080893 | | 7/2008 |
| WO | WO-2008-101884 | | 8/2008 |

OTHER PUBLICATIONS

PCT International Preliminary Report—PCT/IB/338 mailed Sep. 17, 2009—PCT/EP2008/051979.

Hans-Joachim Henke, Baugruppentechnolgie der Elektronik, Hybridtraeger, Verlag Technik Berlin, 1994, pp. 41-45.

* cited by examiner

*Primary Examiner* — Jerome Jackson, Jr.

(74) *Attorney, Agent, or Firm* — Novak Druce Connolly Bove + Quigg LLP

(57) ABSTRACT

The present invention relates to a process for producing a metallized textile surface having one or more articles needing or generating electric current. A formulation having at least one metal powder is applied as a component atop a textile surface patternedly or uniformly. At least one article needing or generating electric current is fixed in at least two locations where formulation was applied. A further metal is deposited on the textile surface.

11 Claims, No Drawings

METHOD FOR PRODUCING METALLISED TEXTILE SURFACES USING ELECTRICITY-GENERATING OR ELECTRICITY-CONSUMING ELEMENTS

CROSS-REFERENCE TO RELATED APPLICATIONS

This application is a national stage application (under 35 U.S.C. §371) of PCT/EP2008/051979, filed Feb. 19, 2008, which claims benefit of European application 07102689.2, filed Feb. 20, 2007.

BACKGROUND OF THE INVENTION

The production of metallized textile fabrics is a field of colossal potential for growth. Metallized textile surfaces find numerous fields of application. Especially metallized textile surfaces can be used for example as heating mantles, also as fashion articles, for example for luminous textiles, or for producing textiles useful in medicine including prophylaxis, for example for monitoring organs and their function. Metallized textile surfaces can further be used to screen off electromagnetic radiation.

It is desirable to provide textiles with articles needing or generating electric current, for example transistors or photocells. However, the attempt to fix such articles on fabrics such that they acquire a contact with electric current, presents difficulties. If an attempt is made to incorporate electrically conducting wires in films, specific apparatus is required.

Especially existing processes for producing such metallized textile surfaces, however, are still very costly, inconvenient and inflexible. Specific equipment is needed and it is not possible to use traditional apparatus such as conventional weaving looms for example. It is known for example to incorporate metal threads in textile. However, in many cases it is not possible to combine for example copper threads and polyester threads satisfactorily with each other to form wovens, since specific looms are needed.

It can be attempted to circumvent the above-described disadvantage by incorporating metal threads in a completely made-up textile. Such a procedure, however, generally requires a lot of work by hand and is costly.

The use of electroconductive polymeric fibers has the additional disadvantage that many electroconductive polymers such as anoxidized polypyrrole for example are air and/or moisture sensitive.

BRIEF SUMMARY OF THE INVENTION

The present invention relates to a process for producing a metalized textile surface comprising one or more articles needing or generating electric current, which comprises (A) applying a formulation comprising at least one metal powder (a) as a component atop a textile surface patternedly or uniformly, (B) fixing at least one article needing or generating electric current in at least two locations where formulation was applied in step (A), (C) depositing a further metal on the textile surface.

The present invention further relates to metalized textile surfaces produced by the process of the present invention and to the use of metalized textile surfaces.

The present invention thus has for its object to provide a process for producing metallized textile surfaces provided with articles needing or generating electric current that obviates the disadvantages described above. The present invention further has for its object to provide metallized textile surfaces provided with articles needing or generating electric current. The present invention further has for its object to provide uses for novel metallized textile surfaces provided with articles needing or generating electric current.

We have found that this object is achieved by the process described herein.

DETAILED DESCRIPTION OF THE PREFERRED EMBODIMENTS

The process described herein proceeds from a textile surface, for example a knit or preferably a woven or a nonwoven. Textile surfaces for the purposes of the present invention can be stiff or preferably flexible. Preferably, they are textile surfaces which can be bent one or more times by hand for example without it being possible to detect a visual difference between before the bending and after the return from the bent state.

Textile surfaces are preferably constituents of textile fabrics or three-dimensionally configured textile material. Textile surfaces for the purposes of the present invention can be of natural fibers or synthetic fibers or mixtures of natural fibers and synthetic fibers. Useful natural fibers include for example wool, flax and preferably cotton. Useful synthetic fibers include for example polyamide, polyester, modified polyester, polyester blend fabric, polyamide blend fabric, polyacrylonitrile, triacetate, acetate, poly-carbonate, polypropylene, polyvinyl chloride, polyester microfibers, preference being given to polyester and blends of cotton with synthetic fibers, in particular blends of cotton and polyester. In another embodiment glass fibers and carbon fibers are suitable.

In one embodiment of the present invention, textile surfaces comprise parts of a composite. For instance, a textile material can be composited with another textile material, for example by adhering, coating, stitching or needling. A textile material can also be composited with another material, in that the textile surface from which the process proceeds can be laminated onto a film, for example a polyester film, a polyolefin film, especially a polyethylene film or a polypropylene film, a polyamide film or a polyurethane film.

In one embodiment of the present invention, the textile surface may comprise a coated textile surface coated for example with binder such as polyurethane binder, polyacrylate binder or styrene-butadiene latex.

In one embodiment of the present invention, the textile surface may comprise a surface atop of which a film is laminated or coated, for example a polypropylene film, a polyester film, a polyethylene film or a polyurethane film, in particular a thermoplastic film of polyurethane.

Especially when textile surfaces selected from wide-meshed knits and loose wovens are to be processed according to the present invention, it may be advantageous for the wide-meshed knit or the wide-meshed woven in question to be used in coated form or to be laminated onto a film.

The process of the present invention is carried out by applying to the textile surface in step (A) a formulation comprising at least one metal powder (a). The applying can be effected for example by blade coating, spraying, roll coating, dipping and especially by printing.

The formulation comprising at least one metal powder (a) may comprise preferably aqueous formulations, especially aqueous liquors and more preferably a printing formulation.

In one preferred embodiment of the present invention, a textile surface is printed in step (A) with a printing formulation, preferably an aqueous printing formulation, comprising at least one metal powder (a).

Examples of printing formulations are printing inks, for example gravure printing inks, offset printing inks, flexographic printing inks, screen printing inks, liquid inks such as for example inks for the Valvoline process and preferably printing pastes, preferably aqueous printing pastes.

Metal powder (a) comprises pulverulent metal, pure or as a mixture or alloy, although the alkali metals and the alkaline earth metals Be, Ca, Sr and Ba shall be excluded. Similarly, of course, the radioactive metals shall be excluded.

Metal powder (a) can be selected for example from pulverulent Al, Zn, Ni, Cu, Ag, Sn, Co, Mn, Fe, Mg, Pb, Cr and Bi, for example pure or as mixtures or in the form of pulverulent alloys of the specified metals with each other or with other metals. Examples of useful alloys are CuZn, CuSn, CuNi, SnPb, SnBi, SnCu, NiP, ZnFe, ZnNi, ZnCo and ZnMn. Preferred metal powders (a) which can be used are iron powder and/or copper powder, and very particular preference is given to iron powder.

In one specific variant, carbon is selected for use as metal powder (a), as graphite in particulate form, carbon black, soot or carbon nanotubes. This variant is particularly preferred when hereinbelow described step (C) utilizes an external source of voltage. Carbon as graphite in particulate form, carbon black, soot or carbon nanotubes is cocomprehended under the term metal powder (a) in the realm of the present invention.

One specific variant utilizes as metal powder (a) a mixture of pulverulent Al, Zn, Ni, Cu, Ag, Sn, Co, Mn, Fe, Mg, Pb, Cr and Bi, especially iron powder on the one hand and, on the other, carbon as graphite in particulate form, carbon black, soot or carbon nanotubes.

In one embodiment of the present invention, metal powder (a) has an average particle diameter in the range from 0.01 to 100 μm, preferably in the range from 0.1 to 50 μm and more preferably in the range from 1 to 10 μm (determined by laser diffraction measurement, for example using a Microtrac X100).

In one embodiment, metal powder (a) is characterized by its particle diameter distribution. For example, the $d_{10}$ value can be in the range from 0.01 to 5 μm, the $d_{50}$ value in the range from 1 to 10 μm and the $d_{90}$ value in the range from 3 to 100 μm, subject to the condition: $d_{10}<d_{50}<d_{90}$. Preferably, no particle has a diameter greater than 100 μm.

Metal powder (a) can be used in passivated form, for example in an at least partially/partly coated form. Examples of useful coatings include inorganic layers such as oxide of the metal in question, $SiO_2$ or $SiO_2$.aq or phosphates for example of the metal in question.

The particles of metal powder (a) can in principle have any desired shape in that for example acicular, cylindrical, lamellar or spherical particles can be used, preference being given to spherical and lamellar particles. The expressions acicular, cylindrical, lamellar and spherical can each relate to idealized forms.

It is particularly preferable to use metal powders (a) having spherical particles, preferably predominantly having spherical particles, most preferably so-called carbonyl iron powders having spherical particles.

Another particularly preferred embodiment utilizes metal powders (a) that are a mixture of spherical particles, most preferably so-called carbonyl iron particles having spherical particles, and lamellar particles, in particular lamellar particles of copper.

Metal powder (a) can in one embodiment of step (A) be applied, preferably printed, such that the particles of metal powder come to lie so close together that they are already capable of conducting electric current. In another embodiment of step (A), metal powder (a) can be applied, preferably printed, such that the particles of metal powder (a) are so far apart from each other that they are not capable of conducting electric current.

The production of metal powders (a) is known per se. For example, common commercial goods can be used or metal powders (a) produced by processes known per se, for example by electrolytic deposition or chemical reduction from solutions of salts of the metals in question or by reduction of an oxidic powder for example by means of hydrogen, by spraying or jetting a molten metal, in particular into cooling media, for example gases or water.

Particular preference is given to using such metal powder (a) as was produced by thermal decomposition of iron pentacarbonyl, herein also referred to as carbonyl iron powder.

The production of carbonyl iron powder by thermal decomposition of, in particular, iron pentacarbonyl $Fe(CO)_5$ is described for example in Ullmann's Encyclopedia of Industrial Chemistry, 5th Edition, Volume A14, page 599. The decomposition of iron pentacarbonyl can be effected for example at atmospheric pressure and for example at elevated temperatures, for example in the range from 200 to 300° C., for example in a heatable decomposer comprising a tube of heat-resistant material such as quartz glass or V2A steel in a preferably vertical position, the tube being surrounded by heating means, for example consisting of heating tapes, heating wires or a heating mantle through which a heating medium flows.

The average particle diameter of carbonyl iron powder can be controlled within wide limits via the process parameters and reaction management in relation to the decomposition stage, and is in terms of the number average in general in the range from 0.01 to 100 μm, preferably in the range from 0.1 to 50 μm and more preferably in the range from 1 to 8 μm.

In one embodiment of the present invention, step (A) utilizes a formulation, preferably a printing formulation, comprising:

(a) at least one metal powder, preference being given to carbonyl iron powder,
(b) at least one binder,
(c) at least one emulsifier, which may be anionic, cationic or preferably nonionic,
(d) if appropriate at least one rheology modifier.

Formulations, especially printing formulations, used according to the present invention may comprise at least one binder (b), preferably at least one aqueous dispersion of at least one film-forming polymer, for example polyacrylate, polybutadiene, copolymers of at least one vinylaromatic with at least one conjugated diene and if appropriate further comonomers, for example styrene-butadiene binders. Further suitable binders (b) are selected from polyurethane, preferably anionic polyurethane, or ethylene-(meth)acrylic acid copolymer.

Useful binder (b) polyacrylates for the purposes of the present invention are obtainable for example by copolymerization of at least one $C_1$-$C_{10}$-alkyl(meth)acrylate, for example methyl acrylate, ethyl acrylate, n-butyl acrylate, n-butyl methacrylate, 2-ethylhexyl acrylate, with at least one further comonomer, for example with a further $C_1$-$C_{10}$-alkyl (meth)acrylate, (meth)acrylic acid, (meth)acrylamide, N-methylol(meth)acrylamide, glycidyl(meth)acrylate or a vinylaromatic compound such as styrene for example.

Useful binder (b) polyurethanes for the purposes of the present invention, which are preferably anionic, are obtainable for example by reaction of one or more aromatic or preferably aliphatic or cycloaliphatic diisocyanates with one or more polyesterdiols and preferably one or more hydroxy carboxylic acids, for example hydroxyacetic acid, or preferably dihydroxy carboxylic acids, for example 1,1-dimethylolpropionic acid, 1,1-dimethylolbutyric acid or 1,1-dimethylolethanoic acid.

Particularly useful binder (b) ethylene-(meth)acrylic acid copolymers are obtainable for example by copolymerization of ethylene, (meth)acrylic acid and if appropriate at least one further comonomer such as for example $C_1$-$C_{10}$-alkyl(meth) acrylate, maleic anhydride, isobutane or vinyl acetate, preferably by copolymerization at temperatures in the range from 190 to 350° C. and pressures in the range from 1500 to 3500 bar and preferably in the range from 2000 to 2500 bar.

Particularly useful binder (b) ethylene-(meth)acrylic acid copolymers may for example comprise up to 90% by weight of interpolymerized ethylene and have a kinematic melt viscosity in the range from 60 $mm^2/s$ to 10 000 $mm^2/s$, preferably in the range from 100 $mm^2/s$ to 5000 $mm^2/s$, measured at 120° C.

Particularly useful binder (b) ethylene-(meth)acrylic acid copolymers may for example comprise up to 90% by weight of interpolymerized ethylene and have a melt flow rate (MFR) in the range from 1 to 50 g/10 min, preferably in the range from 5 to 20 g/10 min and more preferably in the range from 7 to 15 g/10 min, measured at 160° C. under a load of 325 g in accordance with EN ISO 1133.

Particularly useful binder (b) copolymers of at least one vinylaromatic with at least one conjugated diene and if appropriate further comonomers, for example styrene-butadiene binders, comprise at least one ethylenically unsaturated carboxylic acid or dicarboxylic acid or a suitable derivative, for example the corresponding anhydride, in interpolymerized form. Particularly suitable vinylaromatics are para-methylstyrene, α-methylstyrene and especially styrene. Particularly suitable conjugated dienes are isoprene, chloroprene and in particular 1,3-butadiene. Particularly suitable ethylenically unsaturated carboxylic acids or dicarboxylic acids or suitable derivatives thereof are (meth)acrylic acid, maleic acid, itaconic acid, maleic anhydride or itaconic anhydride, to name just some examples.

In one embodiment of the present invention, particularly suitable binder (b) copolymers of at least one vinylaromatic with at least one conjugated diene and if appropriate further comonomers comprise in interpolymerized form:

19.9% to 80% by weight of vinylaromatic, 19.9% to 80% by weight of conjugated diene, 0.1% to 10% by weight of ethylenically unsaturated carboxylic acid or dicarboxylic acid or a suitable derivative, for example the corresponding anhydride.

In one embodiment of the present invention, binder (b) has a dynamic viscosity at 23° C. in the range from 10 to 100 dPa·s and preferably in the range from 20 to 30 dPa·s, determined for example by rotary viscometry, for example using a Haake viscometer.

Emulsifier (c) may be an anionic, cationic or preferably nonionic surface-active substance.

Examples of suitable cationic emulsifiers (c) are for example $C_6$-$C_{18}$-alkyl-, -aralkyl- or heterocyclyl-containing primary, secondary, tertiary or quaternary ammonium salts, alkanolammonium salts, pyridinium salts, imidazolinium salts, oxazolinium salts, morpholinium salts, thiazolinium salts and also salts of amine oxides, quinolinium salts, isoquinolinium salts, tropylium salts, sulfonium salts and phosphonium salts. Examples which may be mentioned are dodecylammonium acetate or the corresponding hydrochloride, the chlorides or acetates of the various 2-(N,N,N-trimethylammonium)-ethylparaffinic esters, N-cetylpyridinium chloride, N-laurylpyridinium sulfate and also N-cetyl-N,N,N-trimethylammonium bromide, N-dodecyl-N,N,N-trimethylammonium bromide, N,N-distearyl-N,N-dimethylammonium chloride and also the gemini surfactant N,N'-(lauryldimethyl)ethylenediamine dibromide.

Examples of suitable anionic emulsifiers (c) are alkali metal and ammonium salts of alkyl sulfates (alkyl radical: $C_8$ to $C_{12}$), of sulfuric acid monoesters of ethoxylated alkanols (degree of ethoxylation: 4 to 30, alkyl radical: $C_{12}$-$C_{18}$) and of ethoxylated alkylphenols (degree of ethoxylation: 3 to 50, alkyl radical: $C_4$-$C_{12}$), of alkylsulfonic acids (alkyl radical: $C_{12}$-$C_{18}$), of alkylarylsulfonic acids (alkyl radical: $C_9$-$C_{18}$) and of sulfosuccinates such as for example sulfosuccinic mono- or diesters. Preference is given to aryl- or alkyl-substituted polyglycol ethers and also to substances described in U.S. Pat. No. 4,218,218, and homologs with y (from the formulae of U.S. Pat. No. 4,218,218) in the range from 10 to 37.

Particular preference is given to nonionic emulsifiers (c) such as for example singly or preferably multiply alkoxylated $C_{10}$-$C_{30}$ alkanols, preferably with three to one hundred mol of $C_2$-$C_4$-alkylene oxide, in particular ethoxylated oxo process or fatty alcohols.

Examples of particularly suitable multiply alkoxylated fatty alcohols and oxo process alcohols are n-$C_{18}H_{37}O$—$(CH_2CH_2O)_{80}$—H,
n-$C_{18}H_{37}O$—$(CH_2CH_2O)_{70}$—H,
n-$C_{18}H_{37}O$—$(CH_2CH_2O)_{60}$—H,
n-$C_{18}H_{37}O$—$(CH_2CH_2O)_{50}$—H,
n-$C_{18}H_{37}O$—$(CH_2CH_2O)_{25}$—H,
n-$C_{18}H_{37}O$—$(CH_2CH_2O)_{12}$—H,
n-$C_{16}H_{33}O$—$(CH_2CH_2O)_{80}$—H,
n-$C_{16}H_{33}O$—$(CH_2CH_2O)_{70}$—H,
n-$C_{16}H_{33}O$—$(CH_2CH_2O)_{60}$—H,
n-$C_{16}H_{33}O$—$(CH_2CH_2O)_{50}$—H,
n-$C_{16}H_{33}O$—$(CH_2CH_2O)_{25}$—H,
n-$C_{16}H_{33}O$—$(CH_2CH_2O)_{12}$—H,
n-$C_{12}H_{25}O$—$(CH_2CH_2O)_{11}$—H,
n-$C_{12}H_{25}O$—$(CH_2CH_2O)_{18}$—H,
n-$C_{12}H_{25}O$—$(CH_2CH_2O)_{25}$—H,
n-$C_{12}H_{25}O$—$(CH_2CH_2O)_{50}$—H,
n-$C_{12}H_{25}O$—$(CH_2CH_2O)_{80}$—H,
n-$C_{30}H_{61}O$—$(CH_2CH_2O)_8$—H,
n-$C_{10}H_{21}O$—$(CH_2CH_2O)_9$—H,
n-$C_{10}H_{21}O$—$(CH_2CH_2O)_7$—H,
n-$C_{10}H_{21}O$—$(CH_2CH_2O)_5$—H,
n-$C_{10}H_{21}O$—$(CH_2CH_2O)_3$—H, and mixtures of the aforementioned emulsifiers, for example mixtures of n-$C_{18}H_{37}O$—$(CH_2CH_2O)_{50}$—H and n-$C_{16}H_{33}O$—$(CH_2CH_2O)_{50}$—H, the indices each being number averages.

In one embodiment of the present invention, formulations, especially printing formulations, used in step (A) can comprise at least one rheology modifier (d) selected from thickeners (d1) and viscosity reducers (d2).

Suitable thickeners (d1) are for example natural thickeners or preferably synthetic thickeners. Natural thickeners are such thickeners as are natural products or are obtainable from natural products by processing such as purifying operations for example, in particular extraction. Examples of inorganic natural thickeners are sheet silicates such as bentonite for example. Examples of organic natural thickeners are preferably proteins such as for example casein or preferably polysaccharides. Particularly preferred natural thickeners are selected from agar agar, carrageenan, gum arabic, alginates such as for example sodium alginate, calcium alginate, ammonium alginate, calcium alginate and propylene glycol alginate, pectins, polyoses, carob bean flour (carubin) and dextrins.

Preference is given to using synthetic thickeners selected from generally liquid solutions of synthetic polymers, in particular acrylates, in for example white oil or as aqueous solutions, and from synthetic polymers in dried form, for example spray-dried powders. Synthetic polymers used as thickeners (d1) comprise acid groups, which are neutralized with ammonia completely or to a certain percentage. In the course of the fixing operation, ammonia is released, reducing the pH and starting the actual fixing process. The pH reduction necessary for fixing may alternatively be effected by adding nonvolatile acids such as for example citric acid, succinic acid, glutaric acid or malic acid.

Very particularly preferred synthetic thickeners are selected from copolymers of 85% to 95% by weight of acrylic acid, 4% to 14% by weight of acrylamide and 0.01 to not more than 1% by weight of the (meth)acrylamide derivative of the formula I

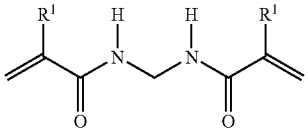

I having molecular weights $M_w$ in the range from 100 000 to 2 000 000 g/mol, in each of which the $R^1$ radicals may be the same or different and may represent methyl or hydrogen.

Further suitable thickeners (d1) are selected from reaction products of aliphatic diisocyanates such as for example trimethylene diisocyanate, tetramethylene diisocyanate, hexamethylene diisocyanate or 1,12-dodecane diisocyanate with preferably 2 equivalents of multiply alkoxylated fatty alcohol or oxo process alcohol, for example 10 to 150-tuply ethoxylated $C_{10}$-$C_{30}$ fatty alcohol or $C_{11}$-$C_{31}$ oxo process alcohol.

Suitable viscosity reducers (d2) are for example organic solvents such as dimethyl sulfoxide (DMSO), N-methylpyrrolidone (NMP), N-ethylpyrrolidone (NEP), ethylene glycol, diethylene glycol, butylglycol, dibutylglycol and for example alkoxylated n-$C_4$-$C_8$-alkanol free of residual alcohol, preferably singly to 10-tuply and more preferably 3- to 6-tuply ethoxylated n-$C_4$-$C_8$-alkanol free of residual alcohol. Residual alcohol refers to the respectively nonalkoxylated n-$C_4$-$C_8$-alkanol.

In one embodiment of the present invention, the formulation, especially printing formulation, used in step (A) comprises from 10% to 90% by weight, preferably from 50% to 85% by weight and more preferably from 60% to 80% by weight of metal powder (a), from 1% to 20% by weight and preferably from 2% to 15% by weight of binder (b), from 0.1% to 4% by weight and preferably up to 2% by weight of emulsifier (c), from 0% to 5% by weight and preferably from 0.2% to 1% by weight of rheology modifier (d), weight % ages each being based on the entire formulation or to be more precise printing formulation used in step (A) and relating in the case of binder (b) to the solids content of the respective binder (b).

One embodiment of the present invention comprises printing in step (A) of the process of the present invention with a formulation, especially printing formulation, which, in addition to metal powder (a) and if appropriate binder (b), emulsifier (c) and if appropriate rheology modifier (d), comprises at least one auxiliary (e). Examples of suitable auxiliaries (e) are hand improvers, defoamers, wetting agents, leveling agents, urea, corrosion inhibitors, actives such as for example biocides or flame retardants.

Suitable defoamers are for example siliconic defoamers such as for example those of the formula HO—$(CH_2)_3$—Si$(CH_3)[OSi(CH_3)_3]_2$ and HO—$(CH_2)_3$—Si$(CH_3)[OSi(CH_3)_3][OSi(CH_3)_2OSi(CH_3)]_3$, nonalkoxylated or alkoxylated with up to 20 equivalents of alkylene oxide and especially ethylene oxide. Silicone-free defoamers are also suitable, examples being multiply alkoxylated alcohols, for example fatty alcohol alkoxylates, preferably 2 to 50-tuply ethoxylated preferably unbranched $C_{10}$-$C_{20}$ alkanols, unbranched $C_{10}$-$C_{20}$ alkanols and 2-ethylhexan-1-ol. Further suitable defoamers are fatty acid $C_8$-$C_{20}$-alkyl esters, preferably $C_{10}$-$C_{20}$-alkyl stearates, in each of which $C_8$-$C_{20}$-alkyl and preferably $C_{10}$-$C_{20}$-alkyl may be branched or unbranched.

Suitable wetting agents are for example nonionic, anionic or cationic surfactants, in particular ethoxylation and/or propoxylation products of fatty alcohols or propylene oxide-ethylene oxide block copolymers, ethoxylated or propoxylated fatty or oxo process alcohols, also ethoxylates of oleic acid or alkylphenols, alkylphenol ether sulfates, alkylpolyglycosides, alkyl phosphonates, alkylphenyl phosphonates, alkyl phosphates or alkylphenyl phosphates.

Suitable leveling agents are for example block copolymers of ethylene oxide and propylene oxide having molecular weights $M_n$ in the range from 500 to 5000 g/mol and preferably in the range from 800 to 2000 g/mol. Very particular preference is given to block copolymers of propylene oxide-ethylene oxide for example of the formula $EO_8PO_7EO_8$, where EO represents ethylene oxide and PO represents propylene oxide.

Suitable biocides are for example commercially obtainable as Proxel brands. Examples which may be mentioned are: 1,2-benzisothiazolin-3-one (BIT) (commercially obtainable as Proxel® brands from Avecia Lim.) and its alkali metal salts; other suitable biocides are 2-methyl-2H-isothiazole-3-one (MIT) and 5-chloro-2-methyl-2H-isothiazol-3-one (CIT).

In one embodiment of the present invention, the formulation, especially printing formulation, used in step (A) comprises up to 30% by weight of auxiliary (e), based on the sum total of metal powder (a), binder (b), emulsifier (c) and if appropriate rheology modifier (d).

A formulation comprising metal powder (a) may be applied in step (A) by spraying, blade coating or dipping for example. Preferably, the applying is embodied as printing.

One embodiment of the present invention comprises applying in step (A) patterns, especially by printing, wherein metal powders (a) are arranged on textile in the form of straight or preferably bent stripy patterns or line patterns, wherein the lines mentioned may have for example a breadth and thickness each in the range from 0.1 μm to 5 mm and the stripes mentioned may have for example a breadth in the range from 5.1 mm to for example 10 cm or if appropriate more and a thickness in the range from 0.1 μm to 5 mm.

One specific embodiment of the present invention comprises applying in step (A) stripy patterns or line patterns of metal powder (a), especially by printing, wherein the stripes and lines, respectively, neither touch nor intersect.

Another specific embodiment of the present invention comprises applying in step (A) stripy patterns or line patterns of metal powder (a), especially by printing, wherein the stripes and lines respectively branch away from each other or unify with each other, for example when the intention is to manufacture printed circuits.

In one embodiment of the present invention, printing in step (A) is effected by various processes which are known per se. One embodiment of the present invention utilizes a stencil through which the formulation, especially printing formulation, comprising metal powder (a) is pressed using a squeegee. The process described above is a screen printing process. Useful printing processes further include gravure printing processes and flexographic printing processes. A further useful printing process is selected from valve-jet processes. Valve-jet processes utilize printing formulation comprising preferably no thickener (d1).

The process of the present invention utilizes formulations, especially printing formulations and more preferably printing pastes comprising, in one embodiment of the present invention, from 10% to 90% by weight and preferably from 50% to 80% by weight of metal powder (a), especially carbonyl iron powder, from 5% to 30% by weight and preferably from 10% to 15% by weight of binder (b), from 0.1% to 4% by weight and preferably up to 2% by weight of emulsifier (c), from 0% to 5% by weight and preferably from 0.2% to 1% by weight of rheology modifier (d), % ages each being based on the entire formulation or to be more precise printing formulation used in step (A).

One embodiment of the present invention utilizes a formulation, especially printing formulation, in the process of the present invention comprising up to 30% by weight of auxiliary (e), based on the sum total of metal powder (a), binder (b), emulsifier (c) and rheology modifier (d).

Formulations, especially printing formulations, used in the process of the present invention may be produced by mixing (a) at least one metal powder, particular preference being given to carbonyl iron powder, (b) at least one binder, (c) at least one emulsifier, and (d) if appropriate at least one rheology modifier, and also if appropriate one or more auxiliaries (e) together in any order.

To produce formulation, especially printing formulation, used in the process of the present invention, one possible procedure is for example to stir together water and if appropriate one or more auxiliaries, for example a defoamer, for example a silicone-based defoamer. Thereafter, one or more emulsifiers can be added.

Next, one or more hand improvers can be added, for example one or more silicone emulsions.

Thereafter one or more emulsifiers (c) and the metal powder or powders (a) can be added.

Subsequently, one or more binders (b) and finally if appropriate one or more rheology modifiers (d) can be added and the mixture homogenized with continued mixing, for example by stirring. Sufficient stirring times are customarily comparatively short, for example in the range from 5 seconds to 5 minutes and preferably in the range from 20 seconds to 1 minute at stirrer speeds in the range from 1000 to 3000 rpm.

The ready-produced formulation, especially printing formulation, in accordance with the present invention may comprise 30% to 70% by weight of white oil when it is to be used as a printing paste. Aqueous synthetic thickeners (d1) preferably comprise up to 25% by weight of synthetic polymer useful as thickener (d1). To use aqueous formulations of thickener (d1), aqueous ammonia is generally added. Similarly, the use of granular, solid formulations of thickener (c) are usable in order that prints may be produced emissionlessly.

The process of the present invention is carried out by fixing in step (B) in at least two locations where a formulation comprising metal powder (a) was applied in step (A) at least one article needing or generating electric current. Such articles are herein also referred to as articles (B).

By "at least two locations" are herein meant such locations of the pattern from step (A) as comprise metal powder (a).

In one embodiment of the present invention, any two of the locations printed in step (A) and to which at least one article needing or generating electric current is fixed in step (B) belong to different parts, for example stripes, of the pattern printed in step (A).

Preferably, any two of the locations specified in step (B) are close together, for example in the range from 0.1 to 5 mm, preferably up to 2 mm.

In one embodiment of the present invention, the articles needing or generating electric current which are fixed in step (B) are relatively small, for example having an average diameter in the range from 1 to 5 mm or less.

In one embodiment of the present invention, articles (B) have at least two terminals of which each one is fixed at the abovementioned location.

Articles (B) may be different in kind or the same.

One embodiment of the present invention selects articles (B) from light-emitting diodes, liquid-crystalline display elements, Peltier elements, transistors, electrochromic dyes, chips (integrated electronic components), resistive elements, capacitive elements, inductive elements, diodes, transistors, actuators, electromechanical elements and solar cells.

Light-emitting diodes, liquid-crystalline display elements, Peltier elements, transistors, electrochromic dyes, chips (integrated electronic components), resistive elements, capacitive elements, inductive elements, diodes, transistors, actuators, electromechanical elements and solar cells are known as such and are commercially available.

In one embodiment of the present invention, the fixing of articles (B) is carried out in conventional mounting processes and systems. Examples of mounting processes and systems are known from circuit board manufacture for example (surface mount technology). Automatic placement machines place for example one or more articles (B) at the particular desired location of the textile surface processed by step (A).

One embodiment of the present invention, where sufficiently small articles (B) are to be fixed, proceeds from articles (B) packed in belts of cardboard or plastic. The belts have pockets holding the articles (B). The upper surface of the pocket is sealed for example by a film which can be peeled off to remove article (B). The belts themselves are wound up on a roll. On at least one side, the roll has holes at regular intervals via which the belt can be forwarded by the automatic placement machine. These rolls are fed to the automatic placement machine by means of feeders. The articles (B) are removed for example with vacuum tweezers or grippers and then placed on the desired position of the textile substrate. This operation is repeated for all articles (B) to be fixed.

In step (C) of the process according to the present invention, a further metal is deposited on the textile surface. One or more further metals may be deposited in step (C), but it is preferable to deposit just one further metal.

The process of the present invention is carried out by depositing a further metal on the textile surface in step (C). "Textile surface" here refers to the textile surfaces previously processed according to steps (A) to (C) and if appropriate further steps such as for example (D).

A plurality of further metals may be deposited in step (C), but it is preferable to deposit just one further metal.

One embodiment of the present invention utilizes carbonyl iron powder as metal powder (a) in step (A) and silver, gold or especially copper as further metal in step (C).

In one embodiment of the present invention, hereinafter also referred to as step (C1), no external source of voltage is used in step (C1) and the further metal in step (C1) has a more strongly positive standard potential in the electrochemical series of the elements, in alkaline or preferably in acidic solution, than the metal underlying metal powder (a) and than hydrogen.

One possible procedure is for textile surface printed in step (A) and thermally treated in step (B) to be treated with a basic, neutral or preferably acidic preferably aqueous solution of salt of further metal and if appropriate one or more reducing agents, for example by placing it into the solution in question.

One embodiment of the present invention comprises treating in step (C1) in the range from 0.5 minutes to 12 hours and preferably up to 30 minutes.

Another embodiment of the present invention comprises treating in step (C1) in the range from 10 seconds to 30 seconds.

One embodiment of the present invention comprises treating in step (C1) with a basic, neutral or preferably acidic solution of salt of further metal, the solution having a temperature in the range from 0 to 100° C. and preferably in the range from 10 to 80° C.

One or more reducing agents may be additionally added in step (C1). When, for example, copper is chosen as further metal, possible reducing agents added include for example aldehydes, in particular reducing sugars or formaldehyde as reducing agent. When, for example, nickel is chosen as further metal, examples of reducing agents which can be added include alkali metal hypophosphite, in particular $NaH_2PO_2.2H_2O$, or boranates, in particular $NaBH_4$.

In another embodiment, hereinafter also referred to as step (C2), of the present invention, an external source of voltage is used in step (C2) and the further metal in step (C2) can have a more strongly or more weakly positive standard potential in the electrochemical series of the elements in acidic or alkaline solution than the metal underlying metal powder (a). Preferably, carbonyl iron powder may be chosen for this as metal powder (a) and nickel, zinc or in particular copper as further metal. In the event that the further metal in step (C2) has a more strongly positive standard potential in the electrochemical series of the elements than hydrogen and than the metal underlying metal powder (a) it is observed that additionally further metal is deposited analogously to step (C1).

Step (C2) may be carried out for example by applying a current having a strength in the range from 10 to 100 A and preferably in the range from 12 to 50 A.

Step (C2) may be carried out for example by using an external source of voltage for a period in the range from 1 to 160 minutes.

In one embodiment of the present invention, step (C1) and step (C2) are combined by initially operating without and then with an external source of voltage and the further metal in step (C) having a more strongly positive standard potential in the electrochemical series of the elements than the metal underlying metal powder (a).

One embodiment of the present invention comprises adding one or more auxiliaries to the solution of further metal. Examples of useful auxiliaries include buffers, surfactants, polymers, in particular particulate polymers whose particle diameter is in the range from 10 nm to 10 μm, defoamers, one or more organic solvents, one or more complexing agents.

Acetic acid/acetate buffers are particularly useful buffers.

Particularly suitable surfactants are selected from cationic, anionic and in particular nonionic surfactants.

As cationic surfactants there may be mentioned for example: $C_6$-$C_{18}$-alkyl-, -aralkyl- or heterocyclyl-containing primary, secondary, tertiary or quaternary ammonium salts, alkanolammonium salts, pyridinium salts, imidazolinium salts, oxazolinium salts, morpholinium salts, thiazolinium salts and also salts of amine oxides, quinolinium salts, isoquinolinium salts, tropylium salts, sulfonium salts and phosphonium salts. Examples which may be mentioned are dodecylammonium acetate or the corresponding hydrochloride, the chlorides or acetates of the various 2-(N,N,N-trimethylammonium)-ethylparaffinic esters, N-cetylpyridinium chloride, N-laurylpyridinium sulfate and also N-cetyl-N,N,N-trimethylammonium bromide, N-dodecyl-N,N,N-trimethylammonium bromide, N,N-distearyl-N,N-dimethylammonium chloride and also the gemini surfactant N,N'-(lauryldimethyl)ethylenediamine dibromide.

Examples of suitable anionic surfactants are alkali metal and ammonium salts of alkyl sulfates (alkyl radical: $C_8$ to $C_{12}$), of sulfuric acid monoesters of ethoxylated alkanols (degree of ethoxylation: 4 to 30, alkyl radical: $C_{12}$-$C_{18}$) and of ethoxylated alkylphenols (degree of ethoxylation: 3 to 50, alkyl radical: $C_4$-$C_{12}$), of alkylsulfonic acids (alkyl radical: $C_{12}$-$C_{18}$), of alkylarylsulfonic acids (alkyl radical: $C_9$-$C_{18}$) and of sulfosuccinates such as for example sulfosuccinic mono- or diesters. Preference is given to aryl- or alkyl-substituted polyglycol ethers and also to substances described in U.S. Pat. No. 4,218,218, and homologs with y (from the formulae of U.S. Pat. No. 4,218,218) in the range from 10 to 37.

Particular preference is given to nonionic surfactants such as for example singly or preferably multiply alkoxylated $C_{10}$-$C_{30}$ alkanols, preferably with three to one hundred mol of $C_2$-$C_4$-alkylene oxide, in particular ethoxylated oxo process or fatty alcohols.

Suitable defoamers are for example siliconic defoamers such as for example those of the formula $HO—(CH_2)_3—Si(CH_3)[OSi(CH_3)_3]_2$ and $HO—(CH_2)_3—Si(CH_3)[OSi(CH_3)_3][OSi(CH_3)_2OSi(CH_3)_3]$, nonalkoxylated or alkoxylated with up to 20 equivalents of alkylene oxide and especially ethylene oxide. Silicone-free defoamers are also suitable, examples being multiply alkoxylated alcohols, for example fatty alcohol alkoxylates, preferably 2 to 50-tuply ethoxylated preferably unbranched $C_{10}$-$C_{20}$ alkanols, unbranched $C_{10}$-$C_{20}$ alkanols and 2-ethylhexan-1-ol. Further suitable defoamers are fatty acid $C_8$-$C_{20}$-alkyl esters, preferably $C_{10}$-$C_{20}$-alkyl stearates, in each of which $C_8$-$C_{20}$-alkyl and preferably $C_{10}$-$C_{20}$-alkyl may be branched or unbranched.

Suitable complexing agents are such compounds as form chelates. Preference is given to such complexing agents as are selected from amines, diamines and triamines bearing at least one carboxylic acid group. Suitable examples are nitrilotriacetic acid, ethylenediaminetetraacetic acid and diethylenepentaminepentaacetic acid and also the corresponding alkali metal salts.

One embodiment of the present invention comprises depositing sufficient further metal as to produce a layer thickness in the range from 100 nm to 500 μm, preferably in the range from 1 μm to 100 μm and more preferably in the range from 2 μm to 50 μm.

Step (C) is carried out by metal powder (a) being in most cases partially or completely replaced by further metal, and the morphology of further deposited metal need not be identical to the morphology of metal powder (a).

On completion of the deposition of further metal (C), metallized textile surfaces in accordance with the present invention are obtained. Metallized textile surfaces in accordance with the present invention can additionally be rinsed once or more times with water for example.

To produce for example such metallized textile surfaces in accordance with the present invention as are to be used for producing display means, electric leads can be secured to the ends in a conventional manner, for example by soldering.

One embodiment of the present invention comprises performing one or more thermal treating steps (D) following step (A), following step (B) or following step (C). In the realm of the present invention, thermal treating steps performed immediately after step (A) shall also be known as thermal treating steps (D1), thermal treating steps performed immediately after step (B) shall also be known as thermal treating steps (D2) and thermal treating steps performed after step (C) shall also be known as thermal treating steps (D3).

When it is desired to carry out a plurality of thermal treating steps, the various thermal treating steps can be carried out at the same temperature or preferably at different temperatures.

Step (D) or each individual step (D) may comprise treating for example at temperatures in the range from 50 to 200° C. Care must be taken to ensure that the thermal treatment of step (D) does not soften or even melt the material of the textile surface used as a starting material. Thus, the temperature is always kept below the softening or melting point of the textile material in question, or the duration of the thermal treatment is made too short for softening or even melting to take place.

Treatment duration in step (D) or each individual step (D) may range for example from 10 seconds to 15 minutes and preferably from 30 seconds to 10 minutes.

Particular preference is given to treating in a first step (D1) at temperatures in the range of for example 50 to 110° C. for a period of 30 seconds to 3 minutes and in a second step (D2), subsequently, at temperatures in the range from 130° C. to 200° C. for a period of 30 seconds to 15 minutes.

Step (D) or each individual step (D) may be carried out in equipment known per se, for example in atmospheric drying cabinets, tenters or vacuum drying cabinets.

In a preferred embodiment of the present invention, step (B) is preceded by performing a further step (E). To perform step (E), some locations on the textile surface provided with metal powder (a) by step (A) have deposited onto them a mixture likewise comprising a metal in preferably powder form that may be different from metal powder (a) or preferably is the same.

One embodiment of the process of the present invention comprises depositing in step (E), at least two printed locations, a mixture likewise comprising metal powder (a). The mixture likewise comprising metal powder (a) may comprise further printing formulation and especially printing paste as used in step (A), or else a mixture comprising further constituents. A third embodiment of step (E) utilizes a preparation comprising soldering tin as mixture likewise comprising metal powder (a).

One embodiment of the present invention comprises depositing in step (E) sufficient mixture comprising metal that the layer thickness of metal is from 2 to 200 times as thick as the layer thickness of metal powder (a) from step (A).

One embodiment of the present invention comprises depositing in step (E) sufficient mixture comprising metal powder (a) that the layer thickness of metal powder (a) on the textile surface is in the range from 0.1 to 5 mm.

In one embodiment of the present invention, metal powder (a) from step (A) differs from metal powder (a) from step (E), preferably by the average particle diameter.

In a preferred embodiment of the present invention, metal powders (a) from step (A) and step (E) are both the same.

One embodiment of the present invention comprises performing dot printing.

After the performance of step (E), step (D) can be repeated. However, preferably, immediately after the performance of step (E), no thermal treatment (D) is carried out and step (B) is performed immediately.

One specific embodiment of the present invention comprises performing after step (C) at least one further step selected from (F) applying a corrosion-inhibiting layer or (G) applying a flexible layer, the corrosion-inhibiting layer being rigid, for example non-bendable, or flexible.

Examples of suitable corrosion-inhibiting layers are layers of one or more of the following materials: waxes, especially polyethylene waxes, paints, for example waterborne paints, 1,2,3-benzotriazole and salts, especially sulfates and methosulfates of quaternized fatty amines, for example lauryl/myristyl-trimethylammonium methosulfate.

Examples of flexible layers are foils, in particular polymeric foils, for example of polyester, polyvinyl chloride, thermoplastic polyurethane (TPU) or especially polyolefins such as for example polyethylene or polypropylene, the terms polyethylene and polypropylene each also comprehending copolymers of ethylene and propylene respectively.

Another embodiment of the present invention comprises applying as flexible layer a binder (b2), which may be the same as or different from any printed binder (b1) from step (A).

The applying may each be effected by laminating, adhering, welding, blade coating, printing, spraying or casting.

When a binder has been applied in step (G), a thermal treatment in accordance with step (D) may again be carried out subsequently.

The present invention further provides metallized textile surfaces obtainable by the process described above. Metallized textile surfaces in accordance with the present invention are not just produced in an efficient and specific manner in that for instance the flexibility and electrical conductivity for example can be influenced in a specific manner via the identity of the printed pattern of metal powder (a) and via the amount of deposited further metal for example. Metallized textile surfaces in accordance with the present invention are versatile in use, for example as a constituent or for production of textiles that convert current into heat, of textiles able to screen off electric fields, of textile-integrated electronic systems, of display means, of roof liners of vehicles, in particular of automobiles, and of textiles able to generate current through photovoltaics.

In one embodiment of the present invention, metallized textile surfaces in accordance with the present invention which have been printed with a line or stripy pattern have a specific resistance in the range from 1 $m\Omega/cm^2$ to 1 $M\Omega/cm^2$ or in the range from 1 $\mu\Omega/cm$ to 1 $M\Omega/cm$, measured at room temperature and along the stripes or lines in question.

In one embodiment of the present invention, metallized textile surfaces printed with a line or stripy pattern and in accordance with the present invention comprise at least two leads secured in a conventional manner, for example soldered, to the respective ends of lines or stripes.

The present invention further provides for the use of metallized textile surfaces in accordance with the present invention as textiles that convert current into heat, as textiles able to screen off electric fields, as textile-integrated electronic systems, as display means, as roof liners of vehicles and as textiles able to generate current, for example through photovoltaics.

The present invention further provides for the use of above-described metallized textile surfaces for producing textiles that convert current into heat, textiles able to screen off electric fields, textile-integrated electronic systems, display means, roof liners of vehicles and textiles able to generate current, for example through photovoltaics.

The present invention further provides textiles that convert current into heat, textiles able to screen off electric fields, textile-integrated electronic systems, display means, roof liners of vehicles and textiles able to generate current, for example through photovoltaics, produced using objects comprising metallized surface in accordance with the present invention.

Examples of textile-integrated electronics are textile-integrated sensors, transistors, chips, light-emitting diodes (LEDs), solar modules, solar cells and Peltier elements. Textiles such as in particular textile-integrated sensors are suitable for example for monitoring the bodily functions of infants or older people. Suitable applications further include high-conspicuity clothing such as high-conspicuity vests for example. Further applications are antennae for example in transponders which can be integrated in RFID tags, textile-integrated chip card modules, the use as flat cable, seat heaters, film conductors, for producing LCD or plasma screens or for producing one- or two-sidedly metal-plated textiles, floors, wall or ceiling lights or as decorative applications of any kind (for example in the textile or packaging sector, but also for decoration of for example cloth bags or shoes).

The present invention further provides processes for producing such textiles that convert current into heat and such textile-integrated electronic systems using metallized textile surfaces in accordance with the present invention. Processes in accordance with the present invention for producing such textiles which convert current into heat using metallized textile surfaces in accordance with the present invention can be carried out for example, by making up textiles having metallized surfaces in accordance with the present invention.

The invention is elucidated by working examples.

I. Production of a Printing Paste

The following were stirred together:

54 g of water 750 g of carbonyl iron powder, $d_{10}$ 3 μm, $d_{50}$ 4.5 μm, $d_{90}$ 9 μm, passivated with a microscopically thin iron oxide layer.

125 g of an aqueous dispersion, pH 6.6, solids content 39.3% by weight, of a random emulsion copolymer of 1 part by weight of N-methylolacrylamide, 1 part by weight of acrylic acid, 28.3 parts by weight of styrene, 69.7 parts by weight of n-butyl acrylate, parts by weight all based on total solids, average particle diameter (weight average) 172 nm, determined by Coulter Counter, $T_g$: −19° C. (binder b.1)

dynamic viscosity (23° C.) 70 mPa·s, 20 g of compound of the formula

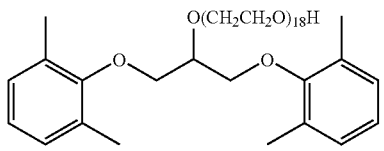

20 g of a 51% by weight solution of a reaction product of hexamethylene diisocyanate with n-$C_{18}H_{37}(OCH_2CH_2)_{15}OH$ in isopropanol/water (volume fractions 2:3)

Stirring was done for 20 minutes at 5000 rpm (Ultra-Thurrax) to obtain a printing paste having a dynamic viscosity of 30 dPa·s at 23° C., measured using a Haake rotary viscometer.

II. Printing of Textile, Step (A), and Thermal Treatment, Step (D1)

The print paste of I. was used to print a polyester nonwoven, basis weight 90 g/cm$^2$ using a 80 mesh sieve with a stripy pattern. The pattern can be found in FIG. 1 as a schematic illustration.

This was followed by drying in a drying cabinet at 100° C. for 10 minutes. A printed and thermally treated polyester nonwoven was obtained.

III. Providing with a Mixture Comprising Metal Powder (a1), Step (E), and Fixing of Articles Requiring Electric Current, Step (B)

Printing paste from I. was again applied by printing, in the form of small circles having a diameter of 2 mm, atop the pattern printed under II.

This was followed by manual distribution of light-emitting diodes of the type "Everlight model 67-22SURSYGC S530-A2/TR8 device number: DSE-672-025 from Everlight Electronics Co., Ltd. in red and green (SUR type AlGaInP for red light-emitting diodes, SYR type AlGaInP for yellow light-emitting diodes), format: 3.2 mm×2.7 mm.

IV. Depositing a Further Metal, Step (C)

IV.1 Depositing Copper without External Source of Voltage

Printed and thermally treated polyester nonwoven of II. was treated for 10 minutes in a bath (room temperature) having the following composition:

1.47 kg of $CuSO_4.5H_2O$ 382 g of $H_2SO_4$ 5.1 l of distilled water 1.1 g of NaCl 5 g of $C_{13}/C_{15}$-alkyl-O-$(EO)_{10}(PO)_5$—$CH_3$ (EO: $CH_2$—$CH_2$—O, PO: $CH_2$—$CH(CH_3)$—O)

The polyester nonwoven was removed, rinsed twice under running water and dried at 90° C. for one hour.

Inventive metallized polyester nonwoven PES-1 was obtained.

V. Coating with a Flexible Layer

The following were stirred together:

260 g of water 700 g of an aqueous dispersion, pH 7.0, solids content 55% by weight, of a random emulsion copolymer of 1 part by weight of N-methylolacrylamide, 1 part by weight of acrylic acid, 28.3 parts by weight of styrene, 69.7 parts by weight of n-butyl acrylate, parts by weight all based on total solids, average particle diameter (weight average) 172 nm, determined by Coulter Counter, $T_g$: −19° C. (binder b.2)

dynamic viscosity (23° C.) 70 mPa·s, 20 g of compound of the formula

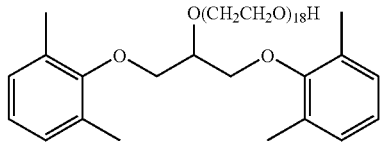

20 g of a 51% by weight solution of a reaction product of hexamethylenediisocyanate with n-$C_{18}H_{37}(OCH_2CH_2)_{15}OH$ in isopropanol/water (volume fractions 2:3)

Stirring was done for 20 minutes at 5000 rpm (Ultra-Thurrax) to obtain a printing paste having a dynamic viscosity of 30 dPa·s at 23° C., measured using a Haake rotary viscometer.

The metallized textile surfaces from IV. were coated with an air knife, application speed 20 m/min, to a pickup of 300 g/m$^2$.

We claim:

1. A process for producing a metallized textile surface for one or more articles needing or generating electric current, which comprises (A) applying a formulation comprising at least one metal powder (a) as a component to a textile surface in a patterned or uniform manner, (B) fixing the one or more one articles needing or generating electric current in at least two locations of the textile surface where the formulation was applied in step (A), and (C) depositing a further metal on the textile surface, wherein an external source of voltage is used in step (C) and the further metal in step (C) has a more strongly or more weakly positive standard potential in the electrochemical series of the elements than the metal in the metal powder (a).

2. The process of claim 1, wherein the formulation used in step (A) comprises:

(a) at least one metal powder, (b) at least one binder, and (c) at least one emulsifier.

3. The process of claim 1, wherein step (A) comprises applying a printing formulation comprising the at least one metal powder (a) to the textile surface by printing.

4. The process of claim 1, further comprising performing one or more thermal treatment steps (D) after steps (A), (B), or (C).

5. The process of claim 1, wherein said metal powder (a) is obtained by thermal decomposition of iron pentacarbonyl.

6. The process of claim 1, wherein the one or more articles needing or generating electric current is selected from the group consisting of light-emitting diodes, liquid-crystalline display elements, Peltier elements, transistors, electrochromic dyes, electromechanical elements and solar cells.

7. The process of claim 2, wherein the emulsifier (c) is selected from nonionic emulsifiers.

8. The process of claim 1, further comprising (F) applying a corrosion-inhibiting layer, wherein the corrosion-inhibiting layer is flexible or rigid.

9. The process of claim 2, wherein the formulation used in step (A) further comprises at least one rheology modifier.

10. The process of claim 8, further comprising (G) applying a flexible layer.

11. A process for producing a metallized textile surface for one or more articles needing or generating electric current, which comprises (A) applying a formulation comprising at least one metal powder (a) as a component to a textile surface in a patterned or uniform manner, (B) fixing the one or more one articles needing or generating electric current in at least two locations of the textile surface where the formulation was applied in step (A), and (C) depositing a further metal on the textile surface, wherein an external source of voltage is used in step (C) and the further metal in step (C) has a more strongly or more weakly positive standard potential in the electrochemical series of the elements than the metal forming the basis of metal powder (a).

* * * * *